US008136265B2

(12) United States Patent
Lee

(10) Patent No.: US 8,136,265 B2
(45) Date of Patent: Mar. 20, 2012

(54) FOOTWEAR SOLE

(75) Inventor: Eun Jae Lee, Busan (KR)

(73) Assignee: Z-Coil Ltd. (KR)

( * ) Notice: Subject to any disclaimer, the term of this patent is extended or adjusted under 35 U.S.C. 154(b) by 435 days.

(21) Appl. No.: 12/467,599

(22) Filed: May 18, 2009

(65) Prior Publication Data

US 2009/0282697 A1 Nov. 19, 2009

(30) Foreign Application Priority Data

May 19, 2008 (KR) ..... 10-2008-0045934

(51) Int. Cl.
*A43B 13/28* (2006.01)
*A43B 13/18* (2006.01)

(52) U.S. Cl. ..... 36/27; 36/35 R; 36/38

(58) Field of Classification Search ..... 36/27, 28, 36/35 R, 36 R, 36 B, 36 C, 38, 7.8
See application file for complete search history.

(56) References Cited

U.S. PATENT DOCUMENTS

| | | | | |
|---|---|---|---|---|
| 1,127,456 | A | 2/1915 | Kurz | |
| 2,387,334 | A * | 10/1945 | Lemke | 36/38 |
| 2,475,092 | A * | 7/1949 | Harrell | 36/7.8 |
| 3,388,485 | A * | 6/1968 | Pierce | 36/7.8 |
| 3,886,674 | A | 6/1975 | Pavia | |
| 3,996,677 | A | 12/1976 | Reina | |
| 4,196,903 | A * | 4/1980 | Illustrato | 482/77 |
| 4,296,557 | A * | 10/1981 | Pajevic | 36/7.8 |
| 4,457,084 | A * | 7/1984 | Horibata et al. | 36/7.8 |
| 4,492,046 | A | 1/1985 | Kosova | |
| 4,566,206 | A | 1/1986 | Weber | |
| 4,592,153 | A | 6/1986 | Jacinto | |
| 5,435,079 | A * | 7/1995 | Gallegos | 36/38 |
| 5,511,324 | A * | 4/1996 | Smith | 36/27 |
| 5,752,329 | A * | 5/1998 | Horibata | 36/27 |
| 7,055,264 | B2 * | 6/2006 | Gallegos | 36/3 B |
| 7,735,240 | B2 * | 6/2010 | Lee | 36/27 |
| 7,937,853 | B2 * | 5/2011 | Kwon et al. | 36/27 |
| 2003/0126760 | A1 * | 7/2003 | LeVert et al. | 36/27 |
| 2006/0213082 | A1 | 9/2006 | Meschan | |
| 2007/0180733 | A1 | 8/2007 | Lee | |
| 2009/0107006 | A1 * | 4/2009 | Ahn et al. | 36/27 |
| 2010/0132224 | A1 * | 6/2010 | Kwon et al. | 36/114 |

* cited by examiner

*Primary Examiner* — Marie Patterson
(74) *Attorney, Agent, or Firm* — Brooks Kushman P.C.

(57) ABSTRACT

Disclosed herein is a footwear sole. The footwear sole includes a coupling seat, a connector and a locking pin. The coupling seat protrudes from the lower surface of a rear mid-sole, and includes a through hole in a central portion thereof, a locking recess formed around the through hole, and at least four pin slits formed at regular intervals. The connector is coupled to the top of the coil spring, and includes a locking protrusion corresponding to the locking recess, an internal threaded part, and a spring seat provided along an edge of an upper surface of the connector. The locking pin is provided at an end of the top of the spring, and protrudes to be fitted into an associated pin slit.

6 Claims, 6 Drawing Sheets

230

FOOTWEAR SOLE

BACKGROUND

1. Technical Field

The present invention relates generally to footwear and, more particularly, to a footwear sole to which a spring is attached, thus contributing to realizing the remedy, prevention and treatment of musculoskeletal disorders.

2. Background Art

Footwear which is a necessity of daily life has been designed to be suitable for special purposes or developed to have various additional functions, in addition to the original function of simply protecting the feet.

A variety of footwear which is used for games or medical treatment has been known to people. As one example of the footwear, US Publication No. 2007-0180773-A1 has been proposed, which was filed by the same inventor (Eun Jae Lee) as the present invention and entitled "shoe sole for correcting gait".

FIG. 1 is an exploded perspective view illustrating the important parts of the conventional footwear sole for correcting gait.

As shown in the drawing, the conventional footwear sole includes a main sole 100, an auxiliary sole 200 and a coupling seat. An upper 400 is coupled to the upper portion of the main sole 100, thus forming the footwear. Especially, the main sole 100 is divided into a front midsole 110 and a rear midsole 120 which are coupled to each other. The front midsole 110 is made of a soft material, while the rear midsole 120 is made of a hard material. The auxiliary sole 200 is coupled to the rear midsole 120. To this end, a flat coupling seat is provided on the lower surface of the rear midsole 120, and a connection member is coupled to the top of a coil spring which is included in the auxiliary sole 200. The rear midsole 120 and the auxiliary sole 200 are fastened to each other by fitting a bolt into the connection member. For the coupling of the connection member with the coil spring, the connection member is integrally provided on the top of the coil spring through injection molding.

However, it is very difficult to manufacture the connection member as described above. Further, there are many restrictions on mass production. Further, a person may have the left and right legs which are considerably different in length from each other. In this case, footwear which is capable of solving a user's congenital or postnatal problem is required.

SUMMARY

Accordingly, the present invention has been made keeping in mind the above problems occurring in the prior art, and an object of the present invention is to provide a footwear sole, which is constructed so that a coil spring and a rear midsole can be more conveniently coupled to each other and the height of an auxiliary sole can be properly adjusted according to a user's bodily shape.

In order to accomplish the above object, the present invention provides a footwear sole having a soft front midsole, a front outsole provided on a lower surface of the front midsole, a hard rear midsole coupled to the front midsole, and an auxiliary sole provided on a lower surface of the rear midsole and having a coil spring coupled to a rear outsole contacting a ground. The footwear sole including a coupling seat, a connector and a locking pin. The coupling seat protrudes from the lower surface of the rear midsole and includes a through hole formed in a central portion of the coupling seat in such a way as to pass through in a vertical direction, a locking recess formed around the through hole, and at least four pin slits formed independently from the locking recess at regular intervals. The connector is coupled to the top of the coil spring and includes a locking protrusion corresponding to the locking recess, an internal threaded part provided on the central portion of the connector, and a spring seat provided along the edge of the upper surface of the connector and bonded with the coil spring using an adhesive. The locking pin is provided at an end of the top of the spring and protruding to be fitted into an associated pin slit.

The connector further includes a positioning hole formed by cutting a start point of the spring seat, and a positioning stopper protrudes from a lower surface of an end of the coil spring and corresponds to the positioning hole to be fitted into the positioning hole.

The footwear sole further includes an auxiliary seat which is installed between the coupling seat and the coil spring, thus adjusting the height of the auxiliary sole according to characteristics of a user's body.

Further, the connector is attached to the coil spring using an adhesive for plastics, and a surface of the coil spring is formed smooth through electro-deposition coating or powder coating.

In order to accomplish the above object, the present invention provides a footwear sole having a soft front midsole, a front outsole provided on a lower surface of the front midsole, a hard rear midsole coupled to the front midsole, and an auxiliary sole provided on a lower surface of the rear midsole and having a coil spring coupled to a rear outsole contacting a ground. The footwear sole includes a coupling seat and a connector. The coupling seat protrudes from the lower surface of the rear midsole and includes a through hole formed in the central portion of the coupling seat in such a way as to pass through in a vertical direction, a locking recess formed around the through hole, and a plurality of curved grooves formed in the coupling seat in such a way as to be positioned outside the locking recess while having a predetermined curvature. The connector is coupled to the top of the coil spring and includes a locking protrusion corresponding to the locking recess, an internal threaded part provided on the central portion of the connector, and a spring seat provided along an edge of an upper surface of the connector and bonded with the coil spring using an adhesive.

Each of the curved grooves is formed to be bent abruptly outwards, thus having a curved shape, and an end of the coil spring is bent to be fitted into the curved groove.

In order to accomplish the above object, the present invention provides a footwear sole having a soft front midsole, a front outsole provided on a lower surface of the front midsole, a hard rear midsole coupled to the front midsole, and an auxiliary sole provided on a lower surface of the rear midsole and having a coil spring coupled to a rear outsole contacting a ground. The footwear sole includes a coupling seat and a connector. The coupling seat protrudes from the lower surface of the rear midsole, and includes a rail groove which is formed in a cross shape and formed to permit horizontal sliding motion but to prevent vertical removal therefrom. The connector is coupled to the top of the coil spring, and includes a straight-line-shaped rail protruding to slide along the rail groove, and a spring seat provided along an edge of an upper surface of the connector and bonded with the coil spring using an adhesive.

A through hole is formed vertically in a central portion of the coupling seat, and an internal threaded part is provided on the central portion of the rail to correspond to the through hole, so that a bolt is fastened to the through hole and the internal threaded part.

Further, in order to accomplish the above object, the present invention provides a footwear sole having a soft front midsole, a front outsole provided on a lower surface of the front midsole, a hard rear midsole coupled to the front midsole, and an auxiliary sole provided on a lower surface of the rear midsole and having a coil spring coupled to a rear outsole contacting a ground. The footwear sole includes a coupling seat, a connector and a coil spring. The coupling seat protrudes from the lower surface of the rear midsole, and includes a through hole formed in a central portion of the coupling seat in such a way as to pass through in a vertical direction, a locking recess formed around the through hole, and a plurality of vertical holes formed in the coupling seat in such a way as to be located outside the locking recess at regular intervals. The connector is coupled to the top of the coil spring, and includes a locking protrusion corresponding to the locking recess, an internal threaded part provided on the central portion of the connector, and a spring seat provided along an edge of an upper surface of the connector and bonded with the coil spring using an adhesive. The coil spring is bent at an end thereof upwards to be fitted into an associated vertical hole.

In order to accomplish the above object, the present invention provides a footwear sole having a soft front midsole, a front outsole provided on a lower surface of the front midsole, a hard rear midsole coupled to the front midsole, and an auxiliary sole provided on a lower surface of the rear midsole and having a coil spring coupled to a rear outsole contacting a ground. The footwear sole includes a coupling seat, a coil spring and a connector. The coupling seat protrudes from the lower surface of the rear midsole, and includes a through hole formed in a central portion of the coupling seat in such a way as to pass through in a vertical direction, and a mounting block protruding around the through hole, forming an imaginary circle, and having cross-shaped fitting spaces formed in the mounting block. The coil spring is coupled at its bottom to the rear outsole, and having on its top a coupling arm, the coupling arm protruding towards a center of the coil spring. The connector has on its central portion an internal threaded part and has in its sidewall a side recess so that the coupling arm is fitted into the side recess, the connector being positioned inside the mounting block and a bolt being fastened to the through hole and the internal threaded part.

Further, the connector is positioned inside the mounting block, and the coupling arm of the coil spring is fitted into any one of the plurality of fitting spaces.

Further, the mounting block further includes a guide part protruding to contact an inner circumference of the coil spring.

In order to accomplish the above object, the present invention provides a footwear sole having a soft front midsole, a hard rear midsole coupled to the front midsole, and a coil spring coupled to a lower surface of the rear midsole. The footwear sole includes a coupling seat, a connector and an outsole. The coupling seat protrudes from the lower surface of the rear midsole, and includes a through hole formed in a central portion of the coupling seat in such a way as to pass through in a vertical direction, and a locking recess formed around the through hole. The connector includes an internal threaded part provided on the central portion of the connector to correspond to the through hole, a locking protrusion fitted into the locking recess, and a spring seat provided along the edge on the upper surface of the connector so that the coil spring is attached to the spring seat. The outsole extends from the lower surface of the front midsole to the rear midsole, the bottom of the coil spring being secured to the outsole.

The outsole is divided into two portions around a junction of the front midsole and the rear midsole.

A functional insertion part is further provided in a wedge-shaped space formed between the rear end of the front midsole and the outsole.

Part of the front midsole is depressed to form a depressed space, and a shock absorbing part made of a softer material is filled in the depressed space.

Further, a tunnel-shaped housing is provided on the upper surface of the outsole or the rear outsole to which the bottom of the coil spring is secured so that part of the coil spring is fitted into the housing, and a housing hole is formed in the lower surface of the outsole or the rear outsole to communicate with an interior of the housing, and a screw hole is formed in an end of the coil spring to be fitted into the housing, so that a bolt is fastened to the screw hole in a vertical direction, thus allowing the coil spring to be fastened to the outsole or rear outsole.

The footwear sole according to the present invention is advantageous in that it is more convenient to manufacture and the height of the footwear sole can be adjusted in consideration of a user's bodily shape, when compared with a conventional footwear sole. Further, the footwear sole of the present invention is applicable to various kinds of footwear and has an excellent shock absorbing function, thus being helpful to persons suffering from various diseases, and especially being useful as special footwear for persons who suffer from musculoskeletal disorders, therefore contributing to the treatment and prevention of the disorders.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Hereinafter, a footwear sole according to the present invention will be described in detail with reference to the accompanying drawings. The drawings are attached to aid the proper understanding of the present invention. Therefore, it should be understood that various changes and modifications may be made to the invention without departing from the spirit and scope thereof.

Figure 1:
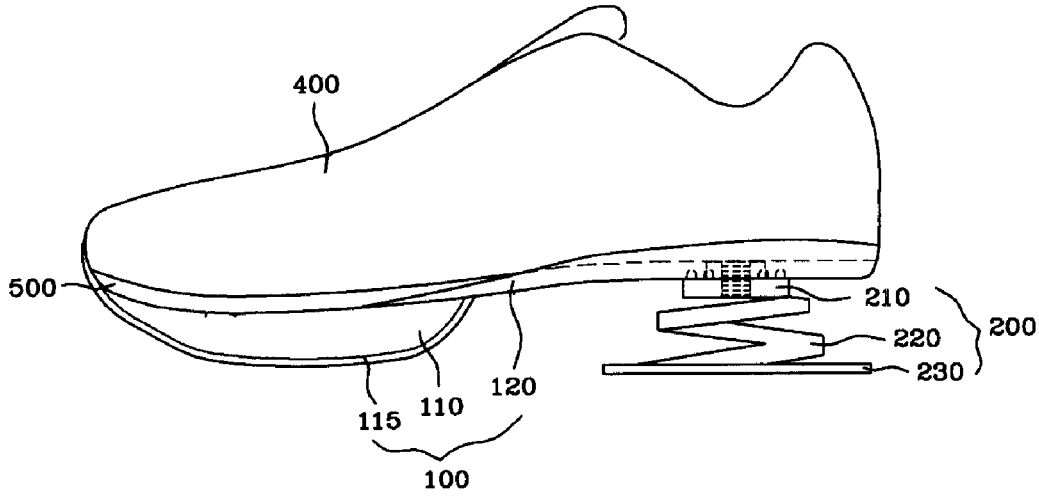
FIG. 1 is a perspective view illustrating the important parts of a conventional footwear sole for correcting the gait.
Figure 2:
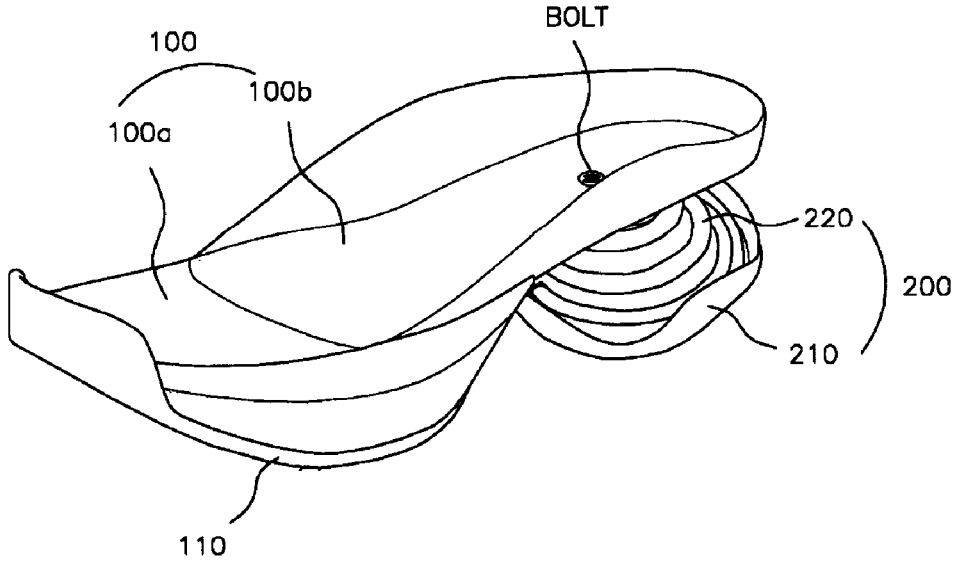
FIG. 2 is a schematic perspective view illustrating a footwear sole according to a first embodiment of the present invention.
Figure 3:
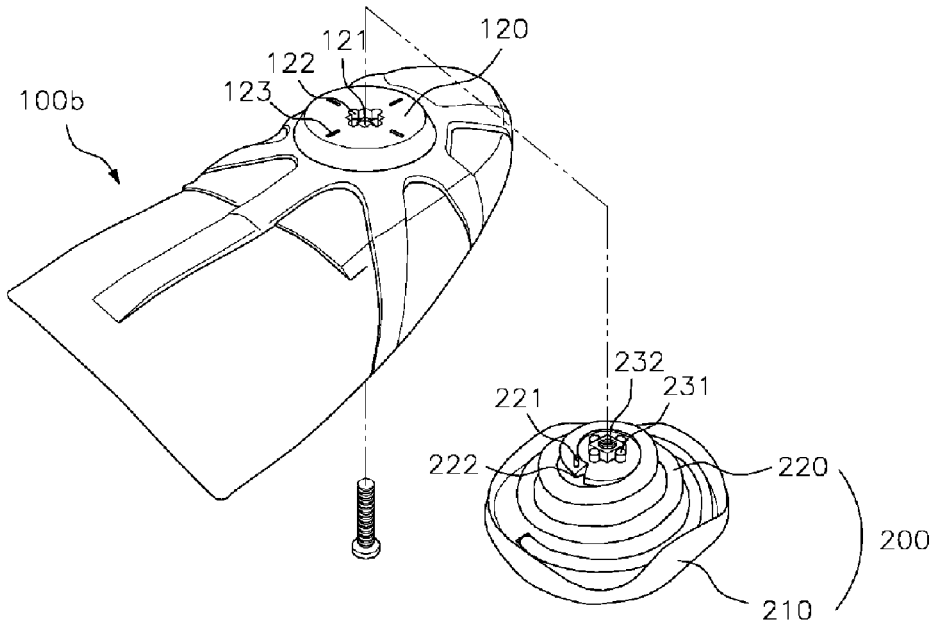
FIG. 3 is an exploded perspective view illustrating the important parts of the footwear sole.
Figure 4:
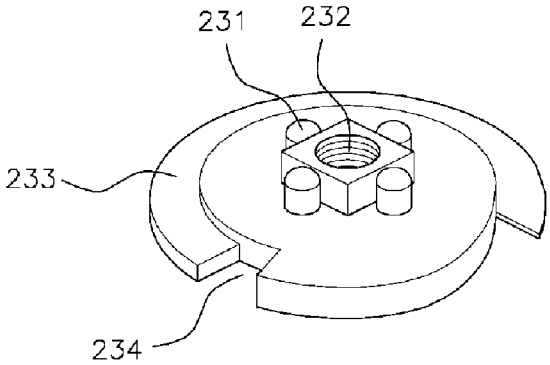
FIG. 4 is a perspective view illustrating a connector included in the footwear sole.
Figure 5:
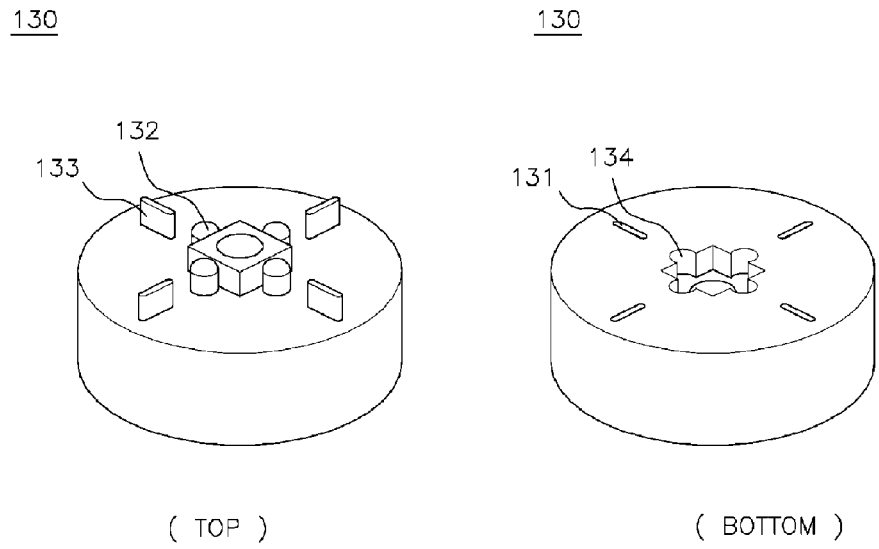
FIG. 5 is a perspective view illustrating an auxiliary seat included in the footwear sole.

To begin, the first embodiment of the present invention will be described below. FIG. 2 is a schematic perspective view illustrating a footwear sole according to the first embodiment, FIG. 3 is an exploded perspective view illustrating the important parts of the footwear sole, FIG. 4 is a perspective view illustrating a connector, and FIG. 5 is a perspective view illustrating an auxiliary seat.

The footwear sole mainly includes a main sole 100 and an auxiliary sole 200. The main sole 100 is a prefabricated midsole which is obtained by coupling a front midsole 100*a* with a rear midsole 100*b*. Of course, a front outsole 110 is coupled to the lower surface of the front midsole 100*a*. The front midsole 100*a* has soft characteristics, because it is formed using a foam such as phylon or urethane. In comparison with the front midsole 100*a*, the rear midsole 100*b* has hard characteristics, has a hard surface and is manufactured using synthetic resin. That is, the front midsole 100*a* has a cushion, whereas the rear midsole 100*b* does not have the cushioning function of absorbing shocks.

The auxiliary sole 200 is coupled to the lower surface of the rear midsole 100*b*. The auxiliary sole 200 includes a rear outsole 210 and a coil spring 220 which is attached to the upper portion of the rear outsole 210. A connector 230 which will be described below in detail is mounted to the top of the coil spring 220, so that the auxiliary sole 200 is fastened to the rear midsole 100*b* using the connector 230. The general construction and coupling structure of the footwear sole according to the present invention remain the same as those of the conventional footwear sole.

Moreover, the present invention improves on the conventional footwear sole and provides an inventive step.

In detail, a coupling seat 120 protrudes from the lower surface of the rear midsole 100*b* in such a way as to be around a position where a wearer's heel is placed. The coupling seat 120 is entirely flat, but a through hole 121 is formed vertically in the central portion of the coupling seat 120. Further, locking recesses 122 are provided around the through hole 121. At least four pin slits 123 are provided at regular intervals independently from the locking recesses 122. That is, as shown in the drawing, according to this embodiment, four pin slits 123 are formed in the coupling seat 120 at angular intervals of 90 degrees. Each pin slit 123 is a straight-line-shaped opening having a narrow width.

The coil spring 220 is coupled to the coupling seat 120, and the connector 230 is provided on the top of the coil spring 230 to mount the coil spring 230 to the coupling seat 120. The connector 230 corresponds to the conventional connection member. However, in the case of the present invention, the connector 230 is separately manufactured and is attached to the top of the coil spring 230 using an adhesive.

The connector 230 includes locking protrusions 231 which are inserted into the corresponding locking recesses 122 formed in the coupling seat 120. An internal threaded part 232 is provided on the central portion of a space surrounded by the locking protrusions 231. The internal threaded part 232 provided inside the locking protrusions 231 is manufactured to have the same shape as a conventional internal threaded part. Meanwhile, as shown in the drawing, a spring seat 233 is provided along the edge of the upper surface of the connector 230 to allow the coil spring 220 to be smoothly coupled to the connector 230. The spring seat 233 is shallowly depressed such that the coil spring 220 is in partial contact with the spring seat 223, and the top of the coil spring 220 is attached to the spring seat 233 using an adhesive.

Preferably, according to the present invention, the coil spring 220 comprises a conical coil spring. The surface of the coil spring 220 is coated through electro-deposition coating or powder coating, so that it becomes smooth. Further, it is preferable that the coil spring 220 and the connector 230 be attached to each other using an adhesive for plastics. This has been learned by the inventor through experience acquired through long-term research.

Here, powder coating is a coating method, which makes synthetic resin into powder, applies the powder to a metal surface, and melts the powder at a high temperature. Meanwhile, electro-deposition coating is a coating method, which puts an object on which a film is to be formed and which has positive or negative polarity into a water-soluble resin paint solution for electro-deposition having opposite polarity and electrically deposits a paint film on the surface of the object by flowing a direct current between the object and the solution having opposite polarities.

The adhesive for plastics is produced by mixing 60-90 weight percent of CR(POLYCHLOROPRENE)- or PU(POLYURETHANE)-based adhesive, 10-30 weight percent of CYANOACRYLATE)-based adhesive and 3-10 weight percent of a hardening accelerator.

Meanwhile, a locking pin 221 protrudes from the top of the coil spring 220 and is fitted into an associated pin slit 123 formed in the coupling seat 120. That is, according to the present invention, when the auxiliary sole 200 is coupled to the rear midsole 100*b*, the locking protrusions 231 of the connector 230 are fitted into the locking recesses 122 of the coupling seat 120, and simultaneously, the locking pin 221 provided on the top of the coil spring 220 is fitted into any one of the pin slits 123 formed around the edge of the coupling seat 120. Finally, a bolt is inserted into the through hole 121 and fastened to the internal threaded part 232 which is provided on the central portion of the connector 230.

Any user may have left and right legs which differ in length from each other for congenital or postnatal reasons. In this case, it is necessary to correct the length of the legs. To this end, if necessary, the auxiliary sole 200 is not directly coupled to the coupling seat 120, but an additional auxiliary seat 130 may be used. That is, in the case where the left and right legs differ in length from each other, the auxiliary seat 130 which has enough height to compensate for the difference of length is first coupled to the coupling seat 120 which is provided on the bottom of the rear midsole 100*b* for the foot of a short leg, and the auxiliary sole 200 is coupled to the auxiliary seat 130.

The connector 230 coupled to the top of the coil spring 220 is aligned with the auxiliary seat 130, and the locking pin 221 provided on the coil spring 220 is aligned with any one of auxiliary pin slits 131 provided in the auxiliary seat 130. Finally, a bolt is fastened and tightened. To this end, as shown in the drawing, the auxiliary seat 130 has on its upper surface auxiliary locking protrusions 132 which are the same as those of the connector 230 to be coupled to the coupling seat 120. Further, wing pieces 133 protrude from the upper surface of the auxiliary seat 130 in such a way as to be fitted into the corresponding pin slits 123 of the coupling seat 120. Auxiliary locking recesses 134 and four auxiliary pin slits 131 are provided in the lower surface of the auxiliary seat 130, as in the coupling seat 120.

Auxiliary seats 130 of various heights may be prepared. Thus, the auxiliary seat 130 of a proper height is selected according to the characteristics of a user's body, thus conveniently correcting a difference in leg length.

In the connector 230 and the coil spring 220, in order to more easily attach the connector 230 to the top of the coil spring 220, a positioning hole 234 is formed in the connector 230 and a positioning stopper 222 protrudes from the lower surface of an end of the coil spring 220 to correspond to the positioning hole 234. In detail, the positioning hole 234 is formed in the start point of the spring seat 233 formed along the edge of the upper surface of the connector 230, and the positioning stopper 222 is fitted into the positioning hole 234, thus conveniently determining the coupling position of the connector 230.

Hereinbefore, the embodiment wherein the footwear sole according to the present invention uses the conical coil spring has been described. However, the coil spring may use all of known shapes including a cylindrical shape, a sandglass shape and an inverted conical shape, in addition to the conical shape. This is appropriately selected according to a user's body condition including weight or height, the existence or non-existence of disease, and the kind of disease.

Further, the coil spring 220 which is part of the auxiliary sole 200 may be fastened to the coupling seat 120 in several directions. Especially in the case of the conical coil spring, support force against load varies according to the direction. Thus, the coil spring 220 may be installed after being turned to a different direction, in consideration of a user's walking characteristics. Since it is described in detail in the related art, it will not be described any more herein.

Figure 6:
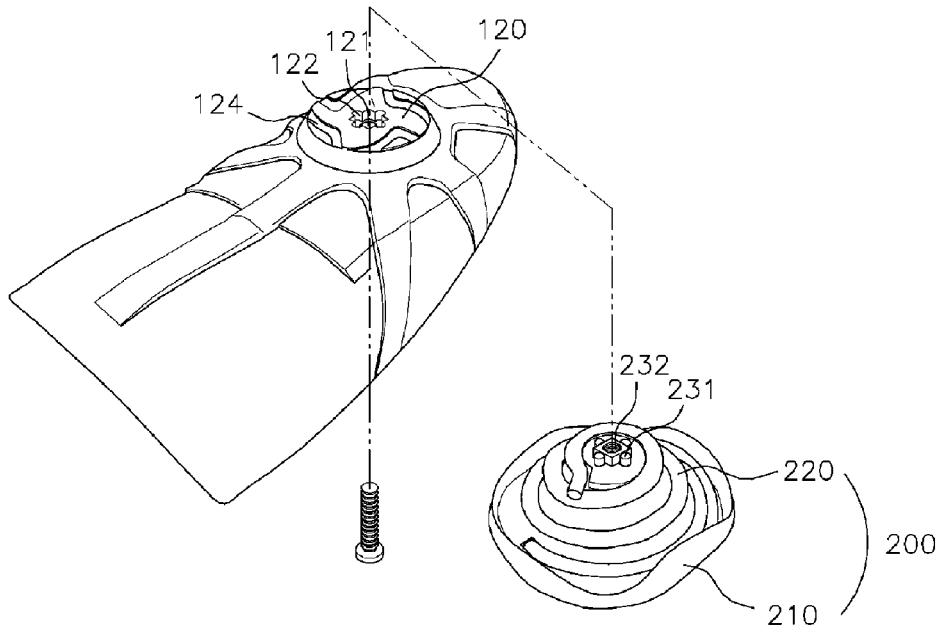
FIG. 6 is an exploded perspective view illustrating the important parts of a footwear sole according to a second embodiment of the present invention.

Hereinafter, the second embodiment of the present invention will be described. FIG. 6 is an exploded perspective view illustrating the important parts of a footwear sole according to the second embodiment.

Similarly to the first embodiment, a front midsole 100*a* is coupled to a rear midsole 100*b*, and an auxiliary sole 200 is attached to the lower surface of the rear midsole 100*b*, thus forming a footwear sole.

Particularly, a coupling seat 120 protrudes from the lower surface of the rear midsole 100*b*, and a through hole 121 is formed vertically through the central portion of the coupling seat 120. Locking recesses 122 are provided around the through hole 121, and a plurality of curved grooves 124 each having a predetermined curvature are formed outside the locking recesses 122. As shown in the drawing, according to this embodiment, several curved grooves 124 having the same shape are arranged around the locking recesses 122. Since the top of a coil spring 220 partially contacts the curved grooves 124, the depth of each curved groove 124 is determined such that part of the coil spring 220 is received in the curved groove 124.

Preferably, each curved groove 124 is formed such that it is bent abruptly outwards to have a curved shape. As such, the curved groove 124 assumes the curved shape resulting from the abrupt change of direction. Thus, it is preferable that an end of the coil spring 220 be also bent to be fitted into the curved groove.

Further, a connector 230 is installed to the top of the coil spring 220. The connector 230 may comprise the same connector as the first embodiment. That is, locking protrusions 231 are provided to correspond to the locking recesses 122, and an internal threaded part 232 is provided on the central portion of a space surrounded by the locking protrusions 231. Further, in order to attach the coil spring 220 to the connector 230 using an adhesive, a spring seat is provided on the connector 230.

According to the second embodiment, a pin slit may be omitted from the coupling seat. In this case, a locking pin is omitted from the coil spring.

Figure 7:
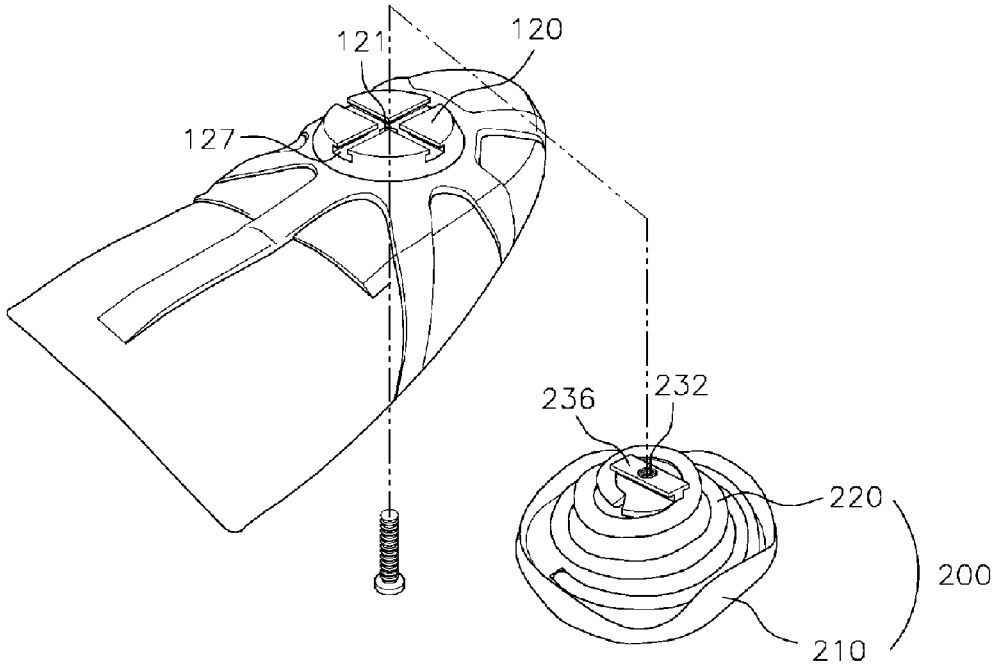
FIG. 7 is an exploded perspective view illustrating a footwear sole according to a third embodiment of the present invention.

Next, the third embodiment of the present invention will be described. FIG. 7 is an exploded perspective view illustrating the important parts of a footwear sole according to the third embodiment.

As shown in the drawing, a coupling seat 120 protrudes from the lower surface of a rear midsole forming the footwear sole. Especially in this embodiment, a rail groove 127 which is depressed in a cross shape is formed in the coupling seat 120. The rail 236 of the connector 230 which will be described below in detail is fitted into the rail groove 127. Here, the horizontal sliding motion of the rail 236 is permitted but the vertical removal of the rail 236 is prevented. The drawing illustrates one example of the rail groove 127.

In order to couple the coil spring 220 to the coupling seat 120, the connector 230 is mounted on the top of the coil spring 220. The straight-line-shaped rail 236 is provided on the upper portion of the connector 230 and slidably fitted into the rail groove 127. Of course, the spring seat 233 is provided along the edge of the upper surface of the connector 230 and bonded to the coil spring 220 using an adhesive.

When the rear midsole 100*b* and the coil spring 220 are coupled to each other using the rail groove 127 formed in the coupling seat 120 and the rail 236 provided on the connector 230, in order to more reliably maintain the coupling, a through hole 121 is formed vertically in the central portion of the coupling seat 120, and an internal threaded part 232 is provided on the central portion of the rail 236 to correspond to the through hole 121. Thereby, a bolt is inserted into the through hole 121 and fastened to the internal threaded part 232.

Figure 8:
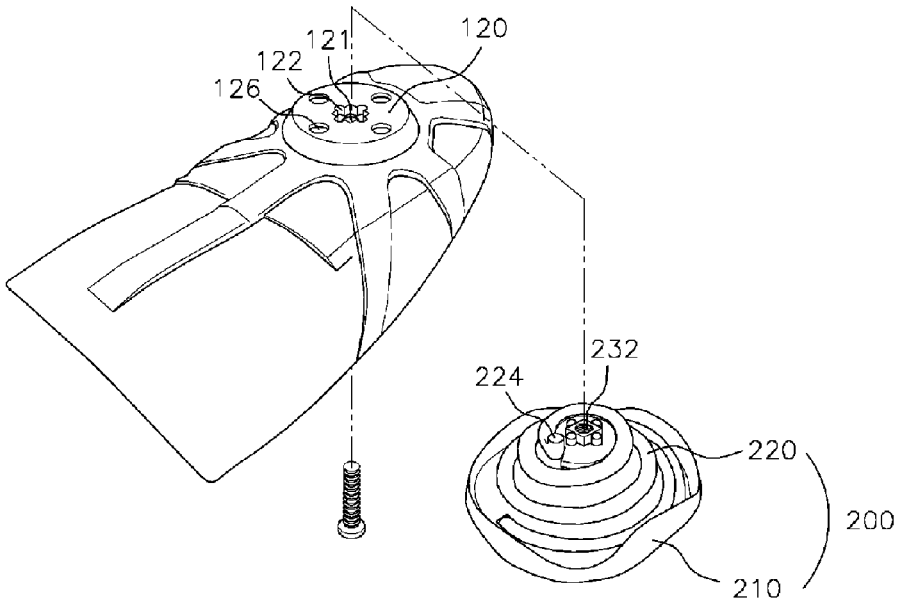
FIG. 8 is an exploded perspective view illustrating a footwear sole according to a fourth embodiment of the present invention.

Next, the fourth embodiment of the present invention will be described. FIG. 8 is an exploded perspective view illustrating a footwear sole according to the fourth embodiment.

As shown in the drawing, a front outsole is provided on the lower surface of a soft front midsole, a hard rear midsole is coupled to the front midsole, and a coil spring is coupled to a rear outsole contacting the ground under the rear midsole to form an auxiliary sole. Such a construction is identical with those of the above-mentioned embodiments.

Particularly, a coupling seat 120 is provided with a through hole 121 and locking recesses 122. A plurality of vertical holes 126 are provided outside the locking recesses 122 at regular intervals. The vertical holes 126 are used when the coil spring 220 is coupled to the coupling seat 120.

According to this embodiment, the distal end of the top of the coil spring 220 is bent upwards. The bent distal end is referred to as an insertion distal end 224. The insertion distal end 224 is fitted into the associated vertical hole 126, so that the auxiliary sole is mounted to the coupling seat 120. Further, the connector is provided on the top of the coil spring. The connector is provided with locking protrusions and an internal threaded part, with a spring seat provided along the edge of the upper surface of the connector.

Figure 9:
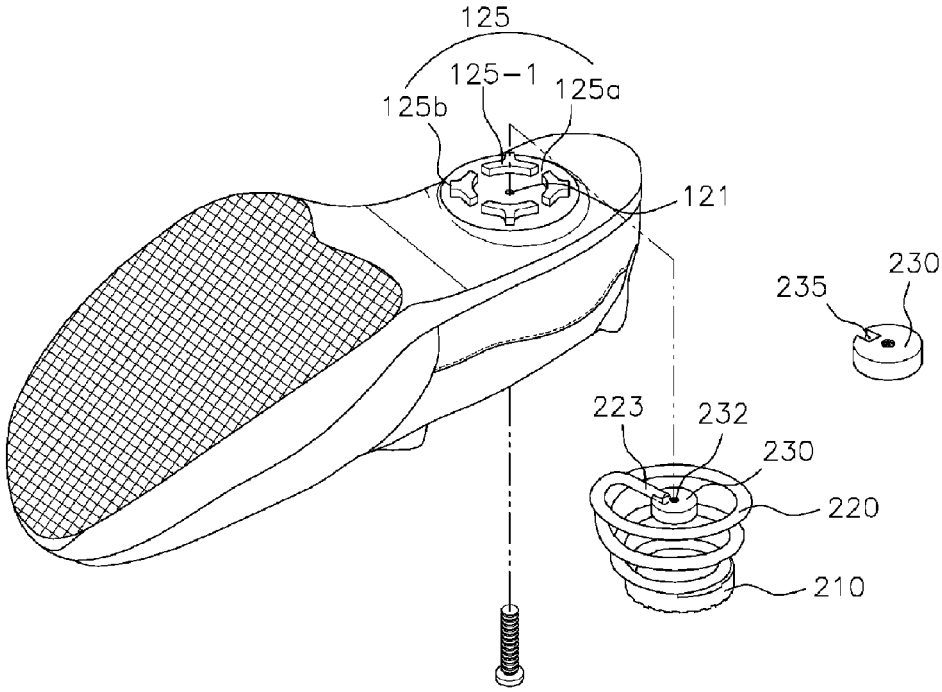
FIG. 9 is an exploded perspective view illustrating a footwear sole according to a fifth embodiment of the present invention.

Hereinafter, the fifth embodiment will be described. FIG. 9 is an exploded perspective view illustrating a footwear sole according to this embodiment.

Similarly to other embodiments, a front midsole and a rear midsole are coupled to each other to form a main sole, and an auxiliary sole equipped with a coil spring is coupled to the rear midsole.

A coupling seat 120 protrudes from the lower surface of the rear midsole 10*b*, with a through hole 121 formed in the central portion of the coupling seat 120. Particularly, a protruding mounting block 125 is provided around the through hole 121 while drawing an imaginary circle. According to this embodiment, the mounting block 125 includes four unit blocks 125-1. The unit blocks 125-1 are spaced apart from each other and arranged in a circular shape. A space between neighboring unit blocks 125-1 is called a fitting space 125*a*. Since the fitting spaces 125*a* are arranged in a cross shape, the fitting spaces 125*a* are provided at four places.

The auxiliary sole 200 is mounted to the coupling seat 120 which is constructed as described above. In this embodiment, a coil spring 220 having an inverted conical shape is applied to the auxiliary sole 200, as shown in the drawing. Since this is selected according to the size of footwear or the like, any shape of coil spring may be used. The rear outsole 210 is coupled to the bottom of the coil spring 220. The top of the coil spring 220 is abruptly bent towards the center of the coil spring 220, thus forming a coupling arm 223.

The coupling arm 223 is connected to the connector 230. An internal threaded part 232 is provided in the central portion of the connector 230 and fastened using a bolt to the through hole 121 which is formed in the coupling seat 120 of the rear midsole 100*b*. According to this embodiment, the connector 230 is a circular plate having a predetermined height. In order to connect the coupling arm 223 to the connector 230, a side recess 235 is formed in the sidewall of the connector 230. The coupling arm 223 is fitted into the side recess 235 of the connector 230. The connector 230 is positioned inside the mounting block 125 and secured to the coupling seat 120. Particularly, part of the coupling arm 223 is fitted into the associated fitting space 125*a* which is formed in the mounting block 125, thus securing the auxiliary sole 200 at a predetermined position. Since the four fitting spaces 125*a* are formed, the installed direction of the auxiliary sole 200 may be appropriately changed by a user.

When the coil spring 220 is mounted to the mounting block 125 provided on the coupling seat 120, the diameter of the coil spring 220 is preferably selected such that the inner circumference of the upper portion of the coil spring 220 tightly fits over the outer circumference of the mounting block 125.

Meanwhile, when the mounting block 125 is formed, preferably, a guide part 125*b* is additionally provided on the mounting block 125 and protrudes to contact with the inner circumference of the coil spring 220. More preferably, a guide part 125*b* protruding outwards is provided on the outer surface of each of the unit blocks 125-1 constituting the mounting block 125, so that the inner circumference of the coil spring 220 contacts the guide part 125*b*.

As in this embodiment, when the inverted-conical coil spring is applied, this is suitable for woman's footwear.

Figure 10:
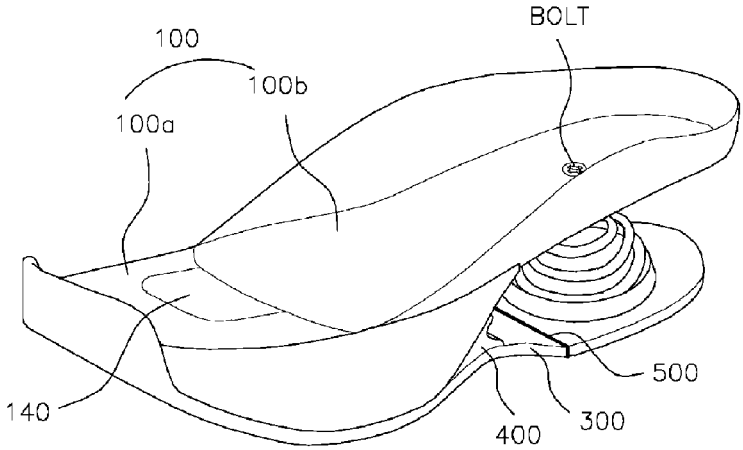
FIG. 10 is a perspective view illustrating a footwear sole according to a sixth embodiment of the present invention.

Next, the sixth embodiment will be described. FIG. 10 is a schematic perspective view illustrating a footwear sole according to the sixth embodiment.

The footwear sole according to the sixth embodiment also has a front midsole 100*a* and a rear midsole 100*b*. A coupling seat 120 is provided on the lower surface of the rear midsole 100*b*, a through hole 121 is formed vertically trough the central portion of the coupling seat 120, and locking recesses 122 are provided around the through hole 121.

Further, a connector 230 is connected to the top of the coil spring 220, and an internal threaded part 232 and locking protrusions 231 are provided on the central portion of the connector 230. In the state where the coil spring 220 contacts the spring seat 233, the connector 230 is bonded to the coil spring using an adhesive.

Particularly, this embodiment is different from the above-mentioned embodiments in that an outsole 300 extends lengthwise from the front midsole 100*a* to the rear midsole 100*b* and is coupled with the bottom of the coil spring 220. That is, the outsole 300 extends from the front midsole 100*a* to the bottom of the coil spring 220, so that there is no cut portion in the outsole 300.

Preferably, the outsole 300 is constructed to be divided into a plurality of portions when necessary. To this end, the portions of the outsole 300 are separated from or coupled to each other around a junction of the front midsole 100*a* and the rear midsole 100*b*. That is, the outsole 300 is formed such that it has no cut portion but is divided into the plurality of portions. In order to divide the outsole 300 into the plurality of portions or to couple the portions into the outsole 300, various structures may be used. For example, a slide fastener 500 may be attached to a coupling portion.

Further, in the sixth embodiment of the present invention, a wedge-shaped space is formed between the rear end of the front midsole 100*a* and the outsole 300. A functional insertion part 400 is fitted into the wedge-shaped space. Here, the functional insertion part 400 is an additional part which has superior elasticity to increase the shock absorbing effect.

Meanwhile, in the above-mentioned first, second, third, fourth and fifth embodiments as well as the sixth embodiment, a depressed space may be provided in a predetermined portion of the front midsole 100*a*, and a shock absorbing part 140 made of a softer material may fill the depressed space. Since the shock absorbing part 140 made of a material which is softer than that of the front midsole 100*a* is attached to the front midsole 100*a*, shocks which are directly transmitted to the sole of the foot when walking are mitigated and the wearing sensation is improved.

Figure 11:
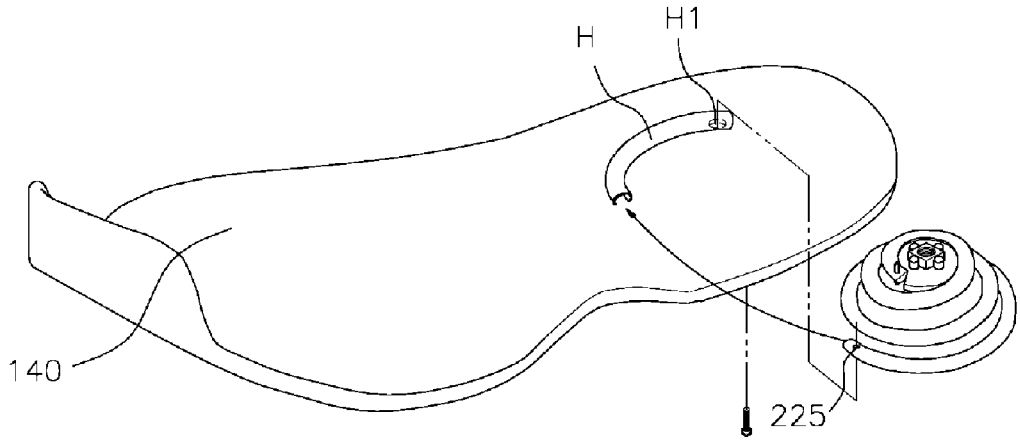
FIG. 11 is a perspective view illustrating the coupling of important parts of a footwear sole according to a seventh embodiment of the present invention.

Finally, the seventh embodiment will be described. FIG. 11 is a perspective view illustrating the coupling between important parts of a footwear sole according to the seventh embodiment.

The footwear sole according to this embodiment is basically constructed so that an outsole 300 or a rear outsole 210 is provided on the lower portion of a coil spring 220. The coil spring 220 may be attached to the outsole 300 or to the rear outsole 210 using an adhesive. Especially in this embodiment, a tunnel-shaped housing H is provided on the upper surface of the outsole 300 or the rear outsole 210, and part of the coil spring 220 is fitted into the housing H.

The position of the housing H is determined in consideration of the position where the coil spring is to be placed. A housing hole H1 is formed in the lower surface of the outsole 300 or the rear outsole 210 in such a way as to communicate with the housing H. Meanwhile, a screw hole 225 is formed in an end of the coil spring 220 which is to be inserted into the housing H to correspond to the housing hole H1, so that the coil spring is fastened to the outsole 300 or the rear outsole 210 using a bolt. When the coil spring is secured to the outsole 300 or the rear outsole 210, an adhesive may also be used in addition to the bolt fastening method using the housing hole H1.

As described above, the present invention provides a footwear sole, which is applicable to various kinds of footwear including running shoes, dress shoes, and casual shoes, and which minimizes shocks when a wearer walks, thus being used for treating a person who suffers from musculoskeletal disorders or preventing the aggravation of the musculoskeletal disorders. Consequently, the footwear sole of the present invention has high industrial applicability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed:

1. A footwear sole having a soft front midsole, a front outsole provided on a lower surface of the front midsole, a hard rear midsole coupled to the front midsole, and an auxiliary sole provided on a lower surface of the rear midsole and having a coil spring coupled to a rear outsole contacting a ground, the footwear sole comprising:

a coupling seat protruding from the lower surface of the rear midsole, and comprising:

a through hole formed in a central portion of the coupling seat in such a way as to pass through in a vertical direction;

a locking recess formed around the through hole; and at least four pin slits formed independently from the locking recess at regular intervals;

a connector coupled to a top of the coil spring, and comprising:

a locking protrusion corresponding to the locking recess;

an internal threaded part provided on a central portion of the connector; and a spring seat provided along an edge of an upper surface of the connector, and bonded with the coil spring using an adhesive; and a locking pin provided at an end of the top of the spring and protruding to be fitted into an associated pin slit.

2. The footwear sole as set forth in claim 1, wherein the connector further comprises a positioning hole formed by cutting a start point of the spring seat, and a positioning stopper protrudes from a lower surface of an end of the coil spring and corresponds to the positioning hole to be fitted into the positioning hole.

3. The footwear sole as set forth in claim 1, further comprising:

an auxiliary seat installed between the coupling seat and the coil spring, and adjusting a height of the auxiliary sole according to characteristics of a user's body.

4. The footwear sole as set forth in claim 1, wherein the connector is attached to the coil spring using an adhesive for plastics, and a surface of the coil spring is formed smooth through electro-deposition coating or powder coating.

5. The footwear sole as set forth in claim 1, wherein part of the front midsole is depressed to form a depressed space, and a shock absorbing part made of a softer material is filled in the depressed space.

6. The footwear sole as set forth in claim 1, wherein a tunnel-shaped housing is provided on an upper surface of the outsole or the rear outsole to which the bottom of the coil spring is secured so that part of the coil spring is fitted into the housing, and a housing hole is formed in a lower surface of the outsole or the rear outsole to communicate with an interior of the housing, and a screw hole is formed in an end of the coil spring to be fitted into the housing, so that a bolt is fastened to the screw hole in a vertical direction, thus allowing the coil spring to be fastened to the outsole or rear outsole.

* * * * *